US006493922B2

(12) United States Patent
Phillips

(10) Patent No.: US 6,493,922 B2
(45) Date of Patent: Dec. 17, 2002

(54) CLIMBING NUT

(75) Inventor: Douglas Phillips, Bend, OR (US)

(73) Assignee: Metolius Mountain Products, Inc., Bend, OR (US)

( * ) Notice: Subject to any disclaimer, the term of this patent is extended or adjusted under 35 U.S.C. 154(b) by 0 days.

(21) Appl. No.: 09/924,069

(22) Filed: Aug. 7, 2001

(65) Prior Publication Data

US 2002/0014566 A1 Feb. 7, 2002

Related U.S. Application Data

(63) Continuation of application No. 09/567,655, filed on May 9, 2000, now Pat. No. 6,273,379.

(51) Int. Cl.[7] ..... B23P 13/04
(52) U.S. Cl. ..... 29/558
(58) Field of Search ..... 29/558, 527.1, 29/527.6, DIG. 47; 248/231.9, 925, 694; 482/37

(56) References Cited

U.S. PATENT DOCUMENTS

| | | | | | |
|---|---|---|---|---|---|
| 3,661,480 | A | * | 5/1972 | Forschner et al. | 418/179 |
| 3,903,785 | A | * | 9/1975 | Pepper, Jr. | 248/694 |
| 3,948,485 | A | * | 4/1976 | Chouinard et al. | 248/694 |
| 3,957,237 | A | * | 5/1976 | Campbell | 248/694 |
| 4,044,976 | A | * | 8/1977 | Campbell | 248/694 |
| 4,082,241 | A | * | 4/1978 | Burkey | 248/317 |
| 4,083,521 | A | | 4/1978 | Greiner | |
| 4,422,607 | A | | 12/1983 | Vallance | |
| 4,643,378 | A | * | 2/1987 | Guthrie et al. | 248/231.9 |
| 5,718,545 | A | * | 2/1998 | Husted | 409/201 |
| 6,050,760 | A | * | 4/2000 | A-Tung | 409/203 |
| 6,070,842 | A | | 6/2000 | Sandahl | |
| 6,119,993 | A | | 9/2000 | Youngblood et al. | |
| 6,145,178 | A | * | 11/2000 | Green | 29/26 A |
| 6,273,379 | B1 | * | 8/2001 | Phillips | 248/231.9 |
| 6,283,426 | B1 | * | 9/2001 | Guthrie et al. | 248/231.9 |

FOREIGN PATENT DOCUMENTS

| | | | | |
|---|---|---|---|---|
| DE | 3526402 A1 | | 2/1987 | |
| EP | 106645 A1 | | 4/1984 | |
| EP | 0323391 | * | 7/1989 | A63B/29/02 |
| FR | 2553668 A1 | | 4/1985 | |
| GB | 2028455 | * | 3/1980 | F16G/11/04 |

OTHER PUBLICATIONS

Photographs of climbing nut 1, front and rear sides labelled A, B, respectively, circa 1995.
Photographs of climbing nut 2, front and rear sides labelled A, B, respectively, circa 1995.

* cited by examiner

*Primary Examiner*—Gregory M. Vidovich
*Assistant Examiner*—Essama Omgba
(74) *Attorney, Agent, or Firm*—Ipsolon LLP

(57) ABSTRACT

A climbing nut is generally trapezoidal and has planar upper and lower faces and paired adjacent faces that are convex and concave, respectively. Opposed faces of the nut are therefore convex and concave, respectively. The convex faces have lateral longitudinally extending leg segments that assist in triangulation and strengthen the nut. The geometry of the faces allows for greater placement options. The nut alternately has one or more asymmetric curved faces. The nut is milled from stock extrusion material.

17 Claims, 4 Drawing Sheets

Fig. 13
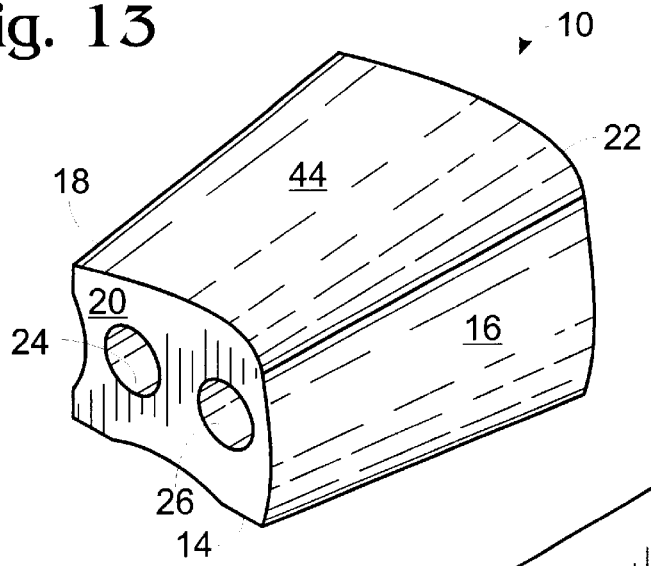
Fig. 14
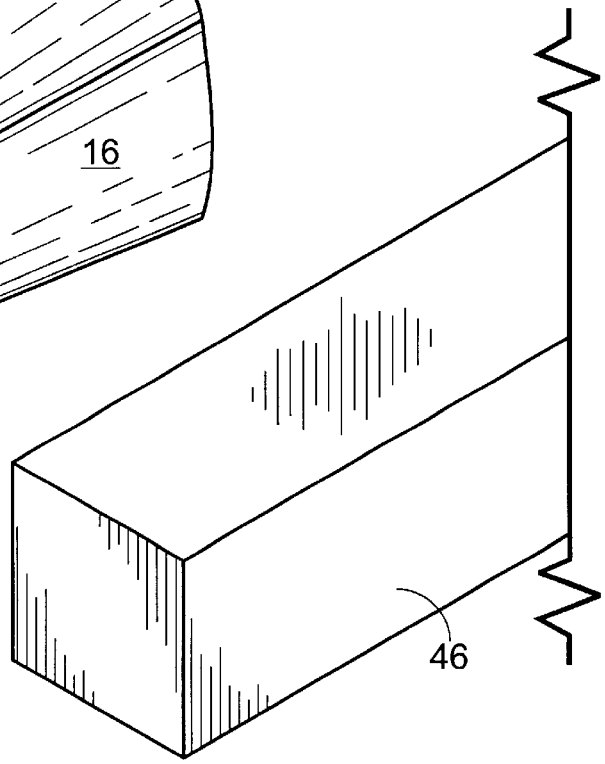
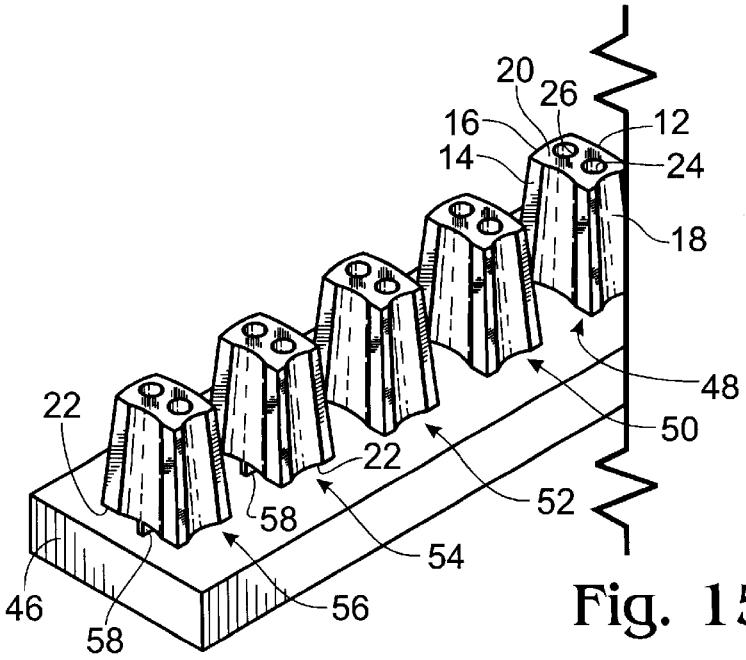
Fig. 15

CLIMBING NUT

RELATED U.S. APPLICATION DATA

Continuation of Ser. No. 09/567,655, filed May 9, 2000, U.S. Pat. No. 6,273,379, issued Aug. 14, 2001.

FIELD OF THE INVENTION

This invention relates passive climbing protection devices, and more particularly, to a climbing nut having curved faces.

BACKGROUND OF THE INVENTION

Climbers use various types of active and passive devices as protection against falls. Active devices generally include some kind of mechanical parts that assist in anchoring the protection on the rock wall. A cam is an example of an active device. Passive devices, on the other hand, do not include mechanical parts for attachment to the rock, and instead rely upon friction and gravitational forces to achieve anchoring. One type of passive protection is a climbing nut, which may also be referred to as a chock.

Climbing nuts are made in many different shapes, but many are generally formed as trapezoidal wedges. During a climb, nuts of appropriate size are wedged into cracks in the rock and a climbing rope is connected indirectly to the nut through various slings and like devices. To ensure proper placement of the nut (i.e., the "protection") it is important that the protection is not moved once it is set in the crack, such as being rocked back and forth in the crack as the rope moves through the attached carabiner. Therefore, each nut includes a loop or sling of cable attached to it. A carabiner is typically attached to the cable and a loop of webbing is attached to the carabiner. Another carabiner is then connected to the opposite end of the webbing and the rope is passed through the second carabiner. This system allows the rope to move freely through the carabiners without unduly moving the nut and risking its coming loose.

The wedge shape allows the nut to be pulled upwardly to release it from its engagement with the rock. As a climber progresses up a climb the nuts may be pulled upwardly and out of the crack when they are no longer needed. The nut may then be reused on the next pitch. On the other hand, if a climber falls the wedge shape of the nut provides a secure anchor, as the climbing rope becomes taut during the fall, thereby arresting the climber's fall.

Proper placement of nuts is obviously very important since improper placement can lead to failure of the protection when it is most needed. One important aspect of the placement is the attainment of triangulation between the nut and the rock. In other words, for proper holding strength it is important that there are at least three points of contact between the nut and the rock. When the nut is properly seated in a crack with proper triangulation the nut provides adequate anchoring strength. However, cracks in rocks are rarely regular in geometric shape. They are, instead, typically curved and irregularly shaped. Moreover, many cracks flare either inwardly or outwardly. With such irregular rock formations it can be difficult in some cases to visually verify that nut placement has achieved correct triangulation.

With standard nuts that are trapezoidal in shape with opposed straight tapered faces the nuts tended to have only two points of contact with the rock. Two points of contact is insufficient for a variety of reasons, including insufficient holding strength, and also the tendency of the nut to pivot back and forth in the rock about the two contact points as the rope moves through the attached carabiners. This pivoting can lead to loosening of the protection and in extreme cases can lead to the nut coming out of the crack. However, with nuts having this geometry visual verification of placement in a crack is relatively easily accomplished.

Various shapes of nuts have been designed over the years to improve placement options and to improve triangulation. As noted, one standard shape is a straight-sided wedge with a constant taper angle. Nuts with this shape are ubiquitous and may be beneficially used in many situations. But given the irregularities in the shapes of cracks, such nuts have limited placement options. Further, while visual verification is easy, unless a crack is relatively straight-sided and the contours of the crack match the geometry of the nut, it can be very difficult to attain proper triangulation. As would be expected, it is a relatively rare occasion when the geometry of a crack conforms to the geometry of a nut. This can lead to the nut pivoting or rocking back and forth in the crack.

Various nut designs have been implemented to increase holding ability and the ability to verify correct placement. One such design shown in U.S. Pat. No. 4,083,521 comprises a "trefoil" nut having three equiangular arms radially extending from a center point. The body of the nut is generally trapezoidal as viewed in a side elevation. The patent notes that the device allows for easy placement and retrieval. However, while this nut does improve the ability to achieve triangulation, it presents limited placement options given the equiangular and equal length radial arms. In addition, visual verification of proper triangulation is difficult.

Another improved nut design is disclosed in U.S. Pat. No. 4,422,607. The nut described in that patent is generally wedge shaped, but two opposite faces of the nut are respectively concave and convex, with the cylindrical axis of the concave and convex curvature extending transverse to the vertical axis through the nut. The nut described in this patent is an improvement over wedge shaped nuts having straight tapering sides since with it triangulation is more easily accomplished. However, with this nut it can be difficult to visually ensure that the nut is properly placed. More particularly, in some placement situations it can be difficult to visually determine if the nut of the '607 patent will be prone to rock out of the placement if a sudden load is placed on the nut, as in a fall. This is because the axis of the curved faces extends across the nut, transverse to the axis along which a load is placed during a fall. Thus, with this geometry it is difficult to verify proper placement in many types of cracks. As noted, many cracks exhibit either inward or outward flaring. Given the geometry of the nut of the '607 patent, placement of the nut in flared cracks is difficult and verification of proper placement is likewise difficult.

Other nuts having a modified wedge shaped have also been developed. For example, in one prior art trapezoidal shaped wedge nut, both opposed "wide" faces of the nut are concave with the cylindrical axis of the concave sections extending generally parallel to the long axis through the nut, and thus parallel to the direction that a load is exerted in a fall. The concave sections define longitudinal rails along the outer sides of the faces. The side faces are planar. In one modified embodiment of this kind of a nut the wide faces have a radius of curvature rather than having a straight sided taper and the top and bottom surfaces are not co-planar. With these nuts, triangulation, while difficult in some crack contours, is generally improved. However, visual inspection tends to be difficult.

There is a need therefore for a climbing nut that improves on prior nuts, provides improved protection and holding strength, provides for more placement options in cracks having varying geometry, and which allows for quick and accurate visual verification of placement.

Prior art nuts such as those described above are typically manufactured by casting, or by cutting extruded stock into desired lengths. For example, the nut described in the '521 patent described above is said to be manufactured from extruded metal or plastic stock. Nuts such as those shown in the '607 patent may also be cut from extruded stock. An alternative method of manufacturing nuts is by well-known forging or casting techniques. With nuts that have variable geometry and multifaceted faces, it is not possible to make suitable extrusion stock material. Moreover, even if stock material could be made it is not always possible or economical to cut the stock into lengths with the cut faces having the proper geometry. In such cases casting is an acceptable alternative method of making the nut.

Both the extrusion and casting methods work well, but both have limitations. For instance, with the extrusion method there are severe limits on the angular geometric face shapes that can be produced. And if the lateral cut sides of the nut are to be any shape other than planar, extrusion cutting is essentially impossible. Cast nuts may be manufactured in virtually any shape. However, casting is a time consuming and sometimes difficult process that requires special equipment. Molds must be made for each specific geometric shape, and quality control over the alloys used must be closely watched.

There is a need therefore for alternative methods of manufacturing nuts having multifaceted faces.

SUMMARY OF THE INVENTION

The advantages of the present invention are achieved in a first preferred embodiment of a wedge shaped climbing nut having side faces that taper from an upper face to a lower face. Both sets of opposed side faces are concave and convex, respectively, and the axis of the concave and convex curved faces extends along the longitudinal axis of the nut along which a load is placed during a fall. Thus, two convex faces are adjacent one another and two concave faces are adjacent one another. The nut of the present invention allows for more placement options in a wider variety of crack formations and allows for better triangulation and visual verification.

As yet another embodiment of the nut of the present invention, one or both of the adjacent convex faces may have an asymmetric radius of curvature. This allows for further placement options.

The nut of the present invention is manufactured by milling the nut from an extruded blank of rectangular material. The milling is accomplished with a specific combination of milling steps, which are carried out according to computer numeric controlled (CNC) processes. By milling the nut from extruded blank stock the alloy consistency of the nut is assured and there is greater flexibility in the geometric configurations for the faces of the nut.

BRIEF DESCRIPTION OF THE DRAWINGS

The invention will be better understood and its numerous objects and advantages will be apparent by reference to the following detailed description of the invention when taken in conjunction with the following drawings.

FIG. 13 is a perspective view of an alternate embodiment of a nut according to the present invention, in which one convex face is asymmetrically curved.

FIG. 14 is a perspective view of an ingot of extruded blank metal from which the nut of the present invention is milled.

FIG. 15 is a perspective view of the ingot of FIG. 14 with several nuts shown in progressive stages of the milling process.

DETAILED DESCRIPTION OF PREFERRED EMBODIMENTS

Figure 1:
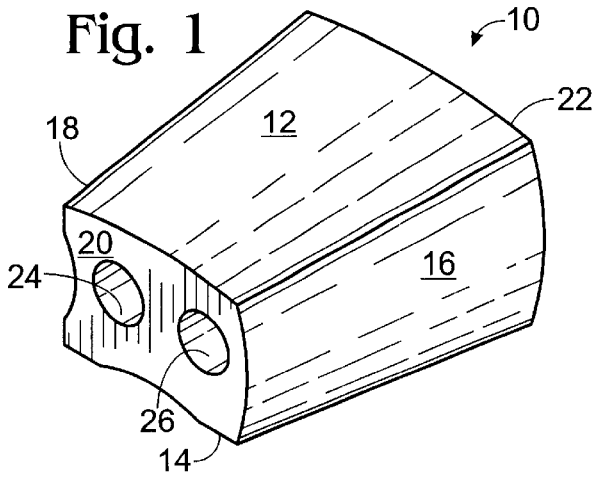
FIG. 1 is a perspective view of a climbing nut according to a preferred embodiment, illustrating the respective adjacent convex side faces of the nut.
Figure 9:
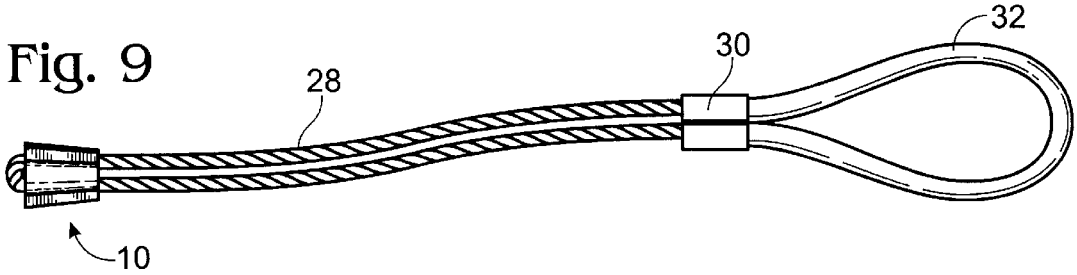
FIG. 9 is a plan view of a nut according to this invention including a cable sling.
Figure 3:
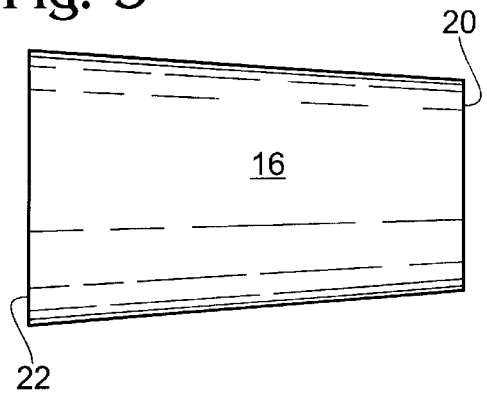
FIG. 3 is an elevational view of the convex side face of the nut of FIG. 1.
Figure 4:
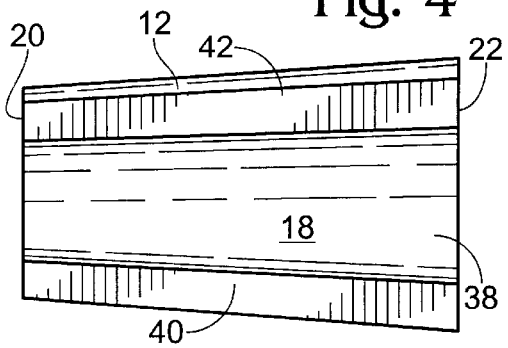
FIG. 4 is an elevational view of the concave side face of the nut of FIG. 1.
Figure 5:
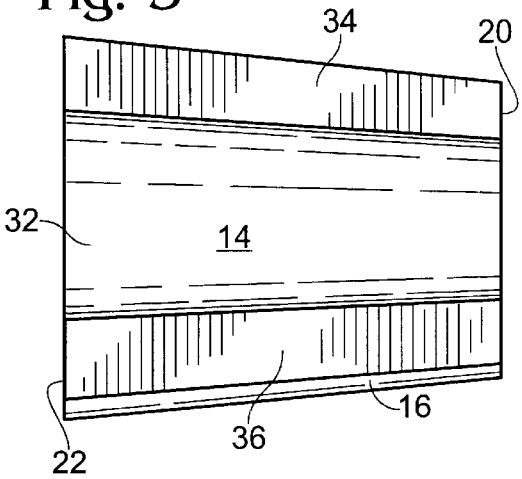
FIG. 5 is a top plan view of the concave front face of the nut of FIG. 1.
Figure 6:
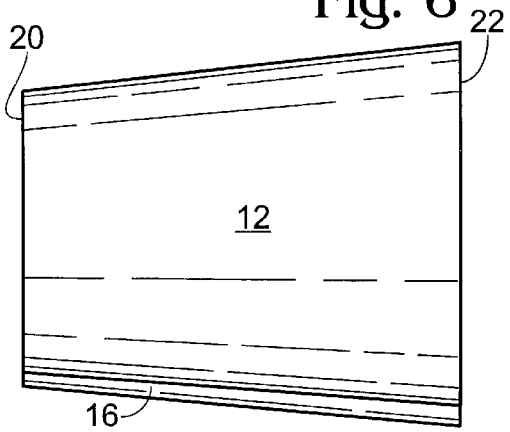
FIG. 6 is a bottom plan view of the convex rear face of the nut of FIG. 1.

Referring to FIG. 1, a nut 10 according to the present invention may be seen as having a generally trapezoidal wedge shape with six surfaces or faces. The following naming convention is used throughout for reference purposes. The two wider faces of nut 10 are convex front face 12 and opposite concave rear face 14. The two relatively narrower lateral side faces are convex side face 16 and opposite concave side face 18. The two opposed end faces are lower end face 20 and upper end face 22. Opposed end faces 20 and 22 are coplanar, and upper end face 22 is larger than lower end face 24. A pair of bores 24 and 26 extend side by side completely through nut 10 parallel to the longitudinal axis through the nut and, as shown in FIG. 9, are designed to receive cable 28 (FIG. 9). Cable 28 thus extends upwardly through bore 24 and is then looped over and runs through bore 26. The two ends of the cable are then connected, for instance with a swaged fitting 30 that defines a looped end 32. Dual bores with a looped cable provide the strongest attachment for the cable and are thus preferred, though alternates (including a single bore) are available depending upon the size of the nut.

The nut of the present invention may be manufactured in various sizes to be used in cracks of various sizes. With the larger nuts a trough may be countersunk or otherwise formed in upper end face 22 between bores 24 and 26 to form a seat for the cable. The seat provides a smoother curvature for the cable and therefore reduces wear on the cable.

Although not shown, in use, a carabiner is connected to looped end 32 of cable 28 (FIG. 9), and a looped section of webbing is connected to the carabiner. A second carabiner is then connected to the opposite end of the webbing, and the climbing rope is run through the second carabiner. It will be appreciated that the nut is designed to be wedged into place such that a load on the nut is exerted in the vertical direction as the nut is placed in a crack. Stated otherwise, the load on the nut when it is under load is preferably exerted in the direction generally parallel to the longitudinal axis through the nut, which as noted above, is parallel to the direction of bores 24, 26.

With reference to FIGS. 3 through 6 it may be seen that the faces 12, 14, 16 and 18 taper angularly from upper end face 22 converging toward lower end face 20. The angle at which the opposed faces taper from face 22 to face 20 is the same for each opposed face, and the taper is thus equiangular. Stated another way, there is a constant taper angle in each of the opposed faces moving from upper end face 22 to lower end face 20. That is, the faces define straight sided and planar tapered surfaces when in side elevation as in FIGS. 3 through 6.

Figure 7:
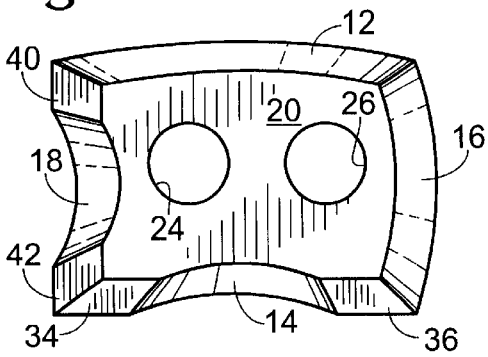
FIG. 7 is a bottom plan view of the nut of FIG. 1.
Figure 8:
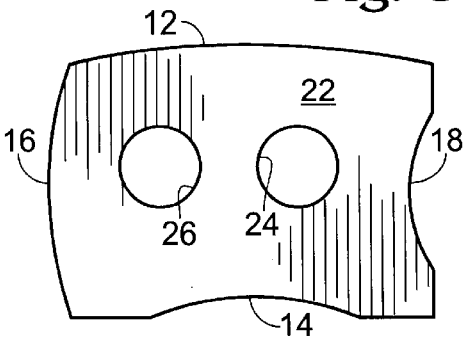
FIG. 8 is a top plan view of the nut of FIG. 1.

The two adjacent convex faces, convex front face 12 and the adjacent convex side face 16, are both radially symmetrically curved about a centerline extending along the faces to define the convex surfaces (see FIGS. 7 and 8). The two adjacent concave faces 14 and 18 similarly have radially symmetrically curved concave channels formed therein to define the concave faces.

Figure 2:
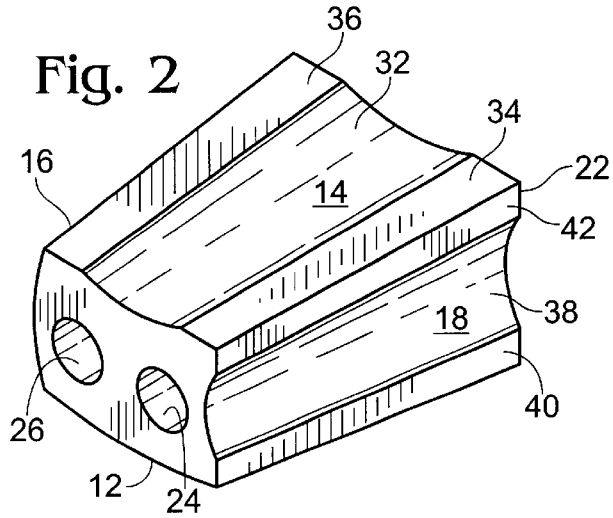
FIG. 2 is a perspective view of the nut shown in FIG. 1 illustrating the respective adjacent concave side faces.

With reference to FIG. 2, a radially curved concave channel 32 extends along the length of concave rear face 14 from lower face 20 to upper face 22. Channel 32 extends laterally from the longitudinal centerline of face 14 outwardly toward the lateral side edges of the face. However, the concave section does not extend completely to the lateral side edges of the face, and instead terminates inwardly of both lateral side edges to define planar leg sections 34 and 36 that extend longitudinally along the lateral edges of the face along the length of the nut. The width of the concave channel 32 increases slightly in the direction from lower face 20 toward upper face 22 (see FIGS. 5 and 7), and the width of each of the planar leg sections 34 and 36 accordingly increases slightly in the same direction length of nut 10. Similarly, a radially curved concave channel 38 extends along the length of concave side face 18 from lower face 20 to upper face 22. Channel 38 extends laterally from the longitudinal centerline of face 18 outwardly toward the sides of the face. However, the concave section does not extend completely to the side edges, and instead terminates inwardly of both side edges to define planar leg sections 40 and 42 that extend longitudinally along the length of the nut. The width of the concave channel 38 increases slightly in the direction from lower face 20 toward upper face 22 (see FIGS. 4 and 7), and the width of planar leg sections 40 and 42 accordingly increases slightly in the same direction along the entire length of nut 10.

As may be seen in the figures, the curvature of the concave and convex faces extends along the axis through the nut defined by bores 24 and 26, as opposed to the curvature of these faces extending transverse to such axis. Thus, a cylindrical axis defined by the respective concave and convex curved surfaces extends in a direction generally the same as the axis through the nut defined by bores 24 and 26. Since the opposed faces of the nut converge from upper face 22 toward lower face 20, the cylindrical axes just mentioned actually either converge toward or diverge from the axis defined by the bores at an angle defined by the angle of the tapered sides. Nonetheless, it will be appreciated that these cylindrical axes of the concave and convex surfaces extend generally parallel to the axis defined by the bores. This orientation may be contrasted with some prior art nuts such as the nut described in U.S. Pat. No. 4,422,607 in which the cylindrical axes defined by the concave and convex surfaces is generally transverse or orthogonal to the axis of the cable-receiving bores.

Figure 10:
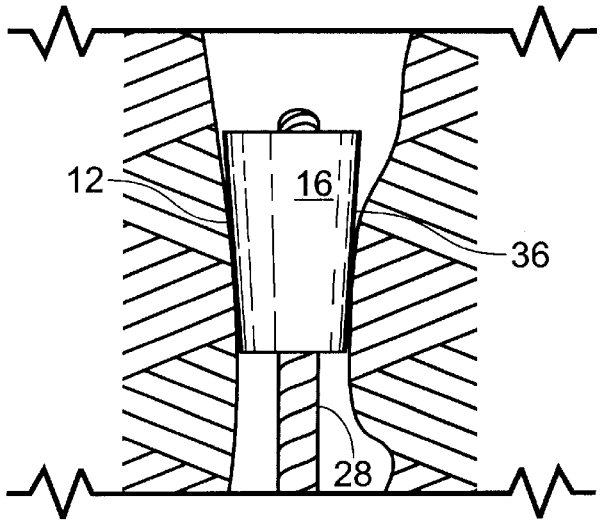
FIG. 10 is a schematic side view showing one placement of a nut according to the present invention in a tapered crack.
Figure 11:
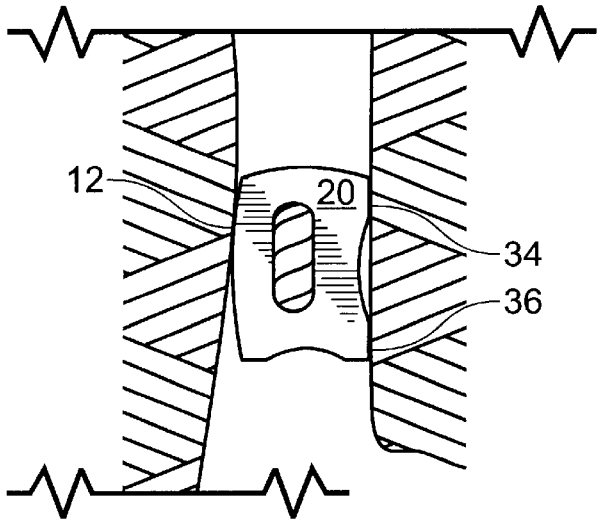
FIG. 11 is schematic top view of a nut of the present invention placed in a flared crack.
Figure 12:
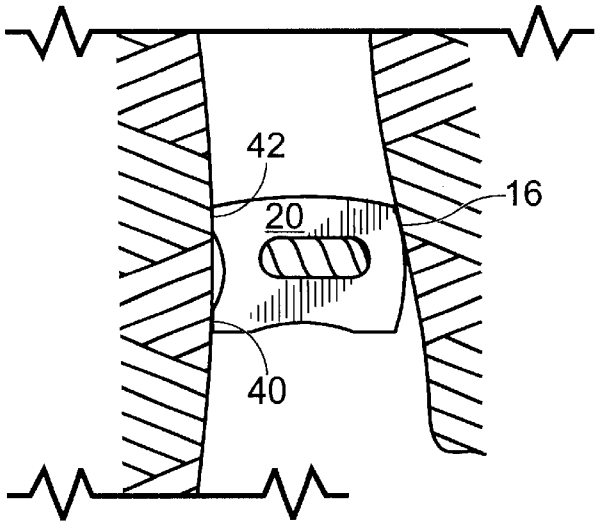
FIG. 12 is a schematic top view similar to the view of FIG. 11 showing an alternate placement of the nut in a flared crack.

FIGS. 10 through 12 show various alternate placement positions for the nut of the present invention. In FIG. 10 the crack in the rock exhibits a downward taper. The nut 10 is placed in the crack such that it makes at least three points of contact with the rock at its convex face 12 and on its concave face 14 on legs 36 and 34 (leg 34 is obscured in the view of FIG. 10). In the event of a fall a sudden and significant load is placed on the nut, and as described above, the load is exerted in the vertical direction, or the direction parallel to the longitudinal axis through the nut. Because legs 34 and 36 define planar sections the load exerted on the nut is spread over a relatively larger area than if the concave channel 32 extended completely to the lateral side edges of face 14. This design thus increases the strength of the nut. The combination of opposed concave and convex faces allows the nut to triangulate regardless of irregularities in the rock formation geometry. Nut 10 thus combines the visual verification advantages of a traditional straight sided tapered wedge with the improved triangulation of curved faces.

Two rock cracks having different flared geometry are illustrated in FIGS. 11 and 12. In FIG. 11 nut 10 is wedged into the crack such that triangulation is achieved on face 12 and on legs 34 and 36, respectively. It will be appreciated that with the cylindrical axis of curvature of the concave and convex faces extending generally along the longitudinal axis of the nut, the relative angle of flaring in the crack will not effect the ability of the nut to triangulate properly, although the actual position of the contact between the rock and the nut will vary according to the contours of the crack. In FIG. 12 a crack having similar flaring geometry is shown, except nut 10 is wedged into the crack with the triangulation or contact points on face 16, and legs 40 and 42. FIG. 12 illustrates that by manufacturing the nut with the two pairs of opposed concave and convex faces, a nut that has a width dimension that is greater that its depth dimension allows the same nut to be used in cracks of different sizes.

An alternate embodiment of nut 10 is shown in FIG. 13. Nut 10 of FIG. 13 has the same basic configuration as the nut shown in FIGS. 1 through 12, except that the curvature of convex front face 44 is asymmetric about a longitudinal centerline extending along the face. The asymmetrically curved face provides for different placement options in cracks having different contours. Moreover, convex side face 16 may likewise be formed with an asymmetric curvature and either one or both of the concave curves on faces 14 and 18 could be asymmetrically curved.

Method of Manufacture

FIG. 14 shows an ingot 46 of extruded metal from which a plurality of nuts 10 will be milled. The alloy composition of ingot 46 is selected according to design preferences and strength requirements, and is closely controlled to meet desired specifications. The size dimensions of ingot 46 depend upon the size of the nuts that will be milled from it, but as can be seen, the ingot is rectangular in sectional shape.

A milling machine utilizing computer numeric control mills a plurality of nuts from ingot 46. Depending upon the type of milling machine that is used, nuts may be milled one at a time or several at a time. Tapered end mill bits are selected for cutting the pieces according to the size and dimensions of the cuts that are being made. For explanatory purposes the milling process will be described with reference to milling a single nut. However, it will be appreciated that some kinds of CNC milling machines allow for simultaneous milling of several pieces.

The CNC machine is under the control of a computer processor, which is informed of appropriate coordinates for making the cuts. An ingot 46 is placed in the CNC mill vise (not shown) and the milling process begins with appropriate tapered end mill bits being loaded into the cutting head. With reference to FIG. 15, the cutting process begins by cutting ingot 46 to mill nut 48. The mill first cuts ingot 46 to define opposed convex front face 12 and concave rear face 14, and opposed convex side face 16 and concave side face 18. Lower end face 20 of nut 48 is defined by the upper surface of ingot 46. Depending upon the types of cuts that are being made, appropriate tooling changes may be necessary during the milling process, for example, interchanging mill bits. Selection of appropriate tooling is within the ordinary ability of those skilled in the art. Bores 24 and 26 are then drilled through nut 48.

At this point the portion of nut 48 that will become upper end face 22 is still an integral part of ingot 46. In FIG. 15, nuts 48, 50 and 52 are all shown with the portion of the nuts that will be the upper-end faces still part of the ingot. When a plurality of nuts have been cut from ingot 46 as described, a side cut saw blade cuts longitudinally along ingot 46 at the "base" of the nuts as shown in FIG. 15 with respect to nuts 54 and 56 to define upper end faces 22. The side cut saw blade does not cut the nuts completely away from the remaining portions of ingot 46. Instead, a flange 58 remains and holds the nuts onto the ingot. With all of the nuts on an ingot cut in this manner, the ingot may be removed from the mill vise and the individual nuts snapped off the ingot by breaking flange 58. This typically may be done by hand. The individual nuts are then deburred to remove and surface blemishes or burrs, and a cable 28 is connected to the nut in the manner described above.

By milling the nuts from an ingot with a CNC milling machine the manufacturing process is essentially a one-step process. Controlling the cutting process closely controls the quality of the nut, and the consistency of the alloy is assured. Moreover, for the reasons described above, with nuts having geometry such as nut 10 of the present invention, the only alternate method of manufacturing is casting the nut. The present method of manufacturing is a marked improvement over casting in terms of quality and efficiency.

While the present invention has been described in terms of a preferred embodiment, it will be appreciated by one of ordinary skill that the spirit and scope of the invention is not limited to those embodiments, but extend to the various modifications and equivalents as defined in the appended claims.

What is claimed is:

1. A method of manufacturing a climbing nut having an upper face and a lower face, a first pair of opposed side faces and a second pair of opposed side faces, the method comprising the steps of:

(a) providing an ingot of a desired size and composition;

(b) cutting said ingot to remove material therefrom to define first and second pairs of opposed side faces of a work piece, and so that one face of each of said pairs defines a concave surface and the opposite face of each of said pairs defines a convex surface, and further so that said concave surfaces have lateral side edges and at least one of said concave surfaces further comprises a concave section extending only partially across said face to define opposed leg sections extending along the lateral edges of said face, and wherein said work piece defines a trapezoid;

(c) drilling at least one bore through said work piece, said bore defining a bore axis; and (d) cutting said work piece in a direction transverse to said bore axis to define said upper face.

2. The method of claim 1 wherein said ingot has a first face that defines said lower face.

3. The method of claim 2 wherein said lower face is smaller than said upper face and said faces are substantially coplanar.

4. The method of claim 1 wherein said concave and convex surfaces defining longitudinal axes that extend in the same general direction as the bore axis.

5. The method of claim 1 wherein step (c) further comprises drilling a plurality of bores through said work piece, and wherein step (d) includes cutting said work piece such that said plurality of bores extend through said upper face.

6. The method of claim 1 including the step of removing said work piece from said ingot and extending a looped cable through said at least one bore.

7. The method of claim 1 further comprising simultaneously cutting plural work pieces from the same ingot.

8. In a method of manufacturing a climbing nut having an upper face and a lower face, and a first pair of opposed side faces and a second pair of opposed side faces, the improvement comprising the steps:

(a) cutting with a mill under the control of a computer an ingot having a desired size and composition to remove material from said ingot to define first and second pairs of opposed side faces of a trapezoidal work piece and such that one face of each of said pairs defines a concave surface and the opposite face of each of said pairs defines a convex surface, and further such that said concave surfaces have lateral side edges and at least one of said concave surfaces further comprises a concave section extending only partially across said face to define opposed leg sections that extend along the lateral edges of said face;

(b) drilling at least one bore through said work piece;

(c) cutting said work piece to define one of said upper or lower faces, and wherein said bore extends through said upper and lower faces.

9. The method of claim 8 wherein said ingot has a first surface that defines said lower face and the cut made in step (c) defines said upper face.

10. The method of claim 8 further comprising simultaneously cutting plural work pieces from said ingot.

11. The method of claim 8 including the step of drilling plural bores through said work piece.

12. The method of claim 11 wherein at least one of the convex surfaces defines a surface that is asymmetrically curved about a longitudinal centerline extending along said surface.

13. The method of claim 8 wherein said lower face is smaller than said upper face to define a work piece that is substantially trapezoidal.

14. The method of claim 13 wherein said side faces taper linearly from said upper face to said lower face.

15. The method of claim 8 including the step of removing said work piece from said ingot and extending a looped cable through said bore.

16. The method of claim 15 including the step of countersinking said bore prior to extending said cable therethrough.

17. The method of claim 8 wherein at least one of the convex surfaces defines a surface that is symmetrically curved about a longitudinal centerline extending along said surface.

* * * * *